US012473901B2

(12) United States Patent
Hao et al.

(10) Patent No.: US 12,473,901 B2
(45) Date of Patent: Nov. 18, 2025

(54) AIR COMPRESSOR CYLINDER HEAD AND AIR COMPRESSOR

(71) Applicant: ZF Commercial Vehicle Systems (Qingdao) Co., Ltd., Qingdao (CN)

(72) Inventors: Xiucheng Hao, Qingdao (CN); Haiqiang Yuan, Qingdao (CN); Xiaoxing Zhao, Qingdao (CN)

(73) Assignee: COMMERCIAL VEHICLE SYSTEMS (QINGDAO) CO., LTD., Qingdao (CN)

( * ) Notice: Subject to any disclaimer, the term of this patent is extended or adjusted under 35 U.S.C. 154(b) by 15 days.

(21) Appl. No.: 18/585,994

(22) Filed: Feb. 23, 2024

(65) Prior Publication Data

US 2024/0287947 A1 Aug. 29, 2024

(30) Foreign Application Priority Data

Feb. 28, 2023 (CN) ..... 202310186830.7

(51) Int. Cl.

| | |
|---|---|
| ***F04B 39/06*** | (2006.01) |
| ***F04B 39/10*** | (2006.01) |
| ***F04B 39/12*** | (2006.01) |
| ***F04B 53/00*** | (2006.01) |
| ***F04B 53/08*** | (2006.01) |

(52) U.S. Cl.

CPC ..... *F04B 39/06* (2013.01); *F04B 39/1066* (2013.01); *F04B 39/122* (2013.01); *F04B 39/123* (2013.01); *F04B 39/125* (2013.01); *F04B 53/007* (2013.01); *F04B 53/08* (2013.01)

(58) Field of Classification Search

CPC ..... F04B 39/06; F04B 39/064; F04B 39/122–125

See application file for complete search history.

(56) References Cited

U.S. PATENT DOCUMENTS

2020/0240403 A1* 7/2020 Burkauskas ..... F16K 15/1821

FOREIGN PATENT DOCUMENTS

| | | | | |
|---|---|---|---|---|
| CN | 106523320 A * | 3/2017 | ..... | F04B 27/04 |
| CN | 110953137 A * | 4/2020 | ..... | F04B 25/005 |
| DE | 10242544 A1 * | 4/2004 | ..... | F04B 39/06 |

* cited by examiner

*Primary Examiner* — Laert Dounis

(74) *Attorney, Agent, or Firm* — WARNER NORCROSS + JUDD LLP

(57) ABSTRACT

An air compressor cylinder head includes a valve seat plate, a manifold plate and a cylinder cover that sequentially cover each other; and an inner cavity of the manifold plate is provided with an air channel and a liquid channel. The air channel is provided with a plurality of air inlets and outlets, the liquid channel is provided with a plurality of liquid inlets and outlets, and the air inlets and outlets and the liquid inlets and outlets are distributed on an end face of the cylinder cover, a side wall of the manifold plate and an end face of the valve seat plate.

11 Claims, 7 Drawing Sheets

AIR COMPRESSOR CYLINDER HEAD AND AIR COMPRESSOR

CROSS-REFERENCE TO RELATED APPLICATIONS

This claims priority to and all advantages of Chinese Application No. 2023101868307 filed on 28 Feb. 2023, the contents of which are incorporated herein by reference.

TECHNICAL FIELD

The present invention relates to the technical field of air compressors, and in particular to an air compressor cylinder head and an air compressor.

BACKGROUND ART

An air compressor may be assembled in a vehicle to provide compressed air energy for a braking system, an air suspension system and the like of the vehicle. The air compressor draws in air through an air inlet, pressurizes air by a compression mechanism, and discharges the pressurized air through an air outlet. In the process of air compression, a lot of heat may be generated. In order to prevent high temperature from shortening the service life of a device and causing other adverse consequences, the air compressor is usually equipped with a cooling system.

In the current air compressor, intake and exhaust channels and inflow and drainage channels of the cooling system are distributed on a cylinder cover and a valve seat plate of a cylinder head, leading to complex structures of the cylinder cover and the valve seat plate; and interfaces such as the air inlet, the air outlet, and a water inlet and a water outlet of the cooling system, due to their simple configurations, fail to adapt to the positions of interfaces of different air compressors.

It should be noted that information disclosed in the above background art section is only used to enhance the understanding of the background of the present invention, and therefore may include information that does not constitute the prior art known to those of ordinary skill in the art.

SUMMARY OF THE INVENTION

In view of this, the present invention provides an air compressor cylinder head and an air compressor, in which an air channel and a liquid channel are arranged on a manifold plate, so that the structures of a valve seat plate and a cylinder cover can be simplified, and a plurality of complex parts can be replaced by one complex part; and the air channel and the liquid channel are respectively provided with a plurality of air inlets and outlets and a plurality of liquid inlets and outlets that are distributed on an end face of the cylinder cover, a side wall of the manifold plate and an end face of the valve seat plate, so that interfaces are flexibly arranged to adapt to the positions of interfaces of different air compressors.

According to one aspect of the present invention, an air compressor cylinder head is provided, including a valve seat plate, a manifold plate and a cylinder cover arranged in sequence; wherein an inner cavity of the manifold plate is provided with an air channel and a liquid channel, the air channel is provided with a plurality of air inlets and outlets, the liquid channel is provided with a plurality of liquid inlets and outlets, and the air inlets and outlets and the liquid inlets and outlets are distributed on an end face of the cylinder cover, a side wall of the manifold plate and an end face of the valve seat plate.

In some embodiments, the inner cavity of the manifold plate includes two layers respectively in communication with the cylinder cover and the valve seat plate; and the air channel and the liquid channel are spread all over the two layers of the manifold plate, and the air channel and the liquid channel are not in communication with each other.

In some embodiments, the air inlet and outlet includes: at least one air inlet distributed on the end face of the cylinder cover; and a plurality of air outlets distributed on the side wall of the manifold plate and the end face of the cylinder cover; the air channel includes: an intake channel leading from the air inlet to an intake hole of the valve seat plate through a first-layer intake cavity of the manifold plate, an intake path between the two layers of the manifold plate and a second-layer intake cavity of the manifold plate; and an exhaust channel leading from an exhaust hole of the valve seat plate to the air outlet through a second-layer exhaust cavity of the manifold plate, an exhaust path between the two layers of the manifold plate and a first-layer exhaust cavity of the manifold plate; wherein the intake cavity and the exhaust cavity of the manifold plate are not in communication with each other.

In some embodiments, the cylinder head further includes: an intake valve arranged on an intake end face of the valve seat plate and covering the intake hole; and an exhaust valve arranged on an exhaust end face of the valve seat plate and covering the exhaust hole.

In some embodiments, the air inlet and out further includes: a plurality of unloading control ports distributed on the end face of the cylinder cover, the side wall of the manifold plate and the end face of the valve seat plate; the air channel further includes: an unloading channel leading from the unloading control port to a piston chamber of the manifold plate; wherein the piston chamber is not in communication with the intake cavity or the exhaust cavity of the manifold plate.

In some embodiments, the liquid inlet and outlet includes: a plurality of liquid inlets distributed on the end face of the cylinder cover and the side wall of the manifold plate; and a plurality of liquid outlets distributed on the end face of the cylinder cover and the side wall of the manifold plate, wherein the liquid outlets and the liquid inlets are distributed at two ends of one or more continuously through liquid channels and are in communication with an external liquid path of the cylinder head; wherein the liquid channel leads from the liquid inlet to the liquid outlet through a first liquid path of a second layer of the manifold plate, a first liquid path between the two layers of the manifold plate, a liquid path of the first layer of the manifold plate, a second liquid path between the two layers of the manifold plate and a second liquid path of the second layer of the manifold plate.

In some embodiments, the liquid inlet and outlet further includes: a pair of crankcase liquid ports which are arranged on the end face of the valve seat plate, are respectively in communication with two ends of the first liquid path of the second layer of the manifold plate and are in communication with a water channel of a crankcase of the air compressor.

In some embodiments, the cylinder head further includes: a plurality of pipeline fixing holes distributed on the side wall of the cylinder cover.

In some embodiments, the pipeline fixing hole is processed into a pre-cast hole.

In some embodiments, the air inlet and outlet and the liquid inlet and outlet are preliminarily processed into blind holes.

In some embodiments, the cylinder head further includes: two sealing gaskets respectively arranged between the cylinder cover and the manifold plate, and between the manifold plate and the valve seat plate.

According to another aspect of the present invention, an air compressor is provided, and a crankcase of the air compressor is covered with an air compressor cylinder head as described in any one of the above embodiments.

Compared with the prior art, the present invention has at least the following beneficial effects:

in the air compressor cylinder head and the air compressor according to the present invention, the manifold plate is arranged between the valve seat plate and the cylinder cover of the cylinder head, and the air channel and the liquid channel are arranged on the manifold plate, so that the structures of the valve seat plate and the cylinder cover can be simplified, and a plurality of complex parts can be replaced by one complex part, which simplifies processing of the cylinder head;

the air channel and the liquid channel are respectively provided with the plurality of air inlets and outlets and the plurality of liquid inlets and outlets that are distributed on the end face of the cylinder cover, the side wall of the manifold plate and the end face of the valve seat plate, so that interfaces are flexibly arranged to adapt to the positions of interfaces of different air compressors; and in addition, the air channel and the liquid channel are arranged in the inner cavity of the manifold plate, so that the manifold plate is relatively thick, which in turn makes the interfaces on the side wall of the manifold plate be arranged more flexibly, and also facilitates adequate distribution of the air channel and the liquid channel in the inner cavity of the manifold plate, thereby improving the heat dissipation effect.

It should be understood that the above general description and the following detailed description are only exemplary and explanatory, and cannot limit the present invention.

BRIEF DESCRIPTION OF THE DRAWINGS

The accompanying drawings herein, which are incorporated into and constitute a part of the description, illustrate embodiments consistent with the present invention and, together with the description, are used to explain principles of the present invention. Obviously, the accompanying drawings described below show merely some of the embodiments of the present invention, and those of ordinary skill in the art would also have obtained other accompanying drawings according to these accompanying drawings without any creative effort.

DETAILED DESCRIPTION OF EMBODIMENTS

Figure 1:
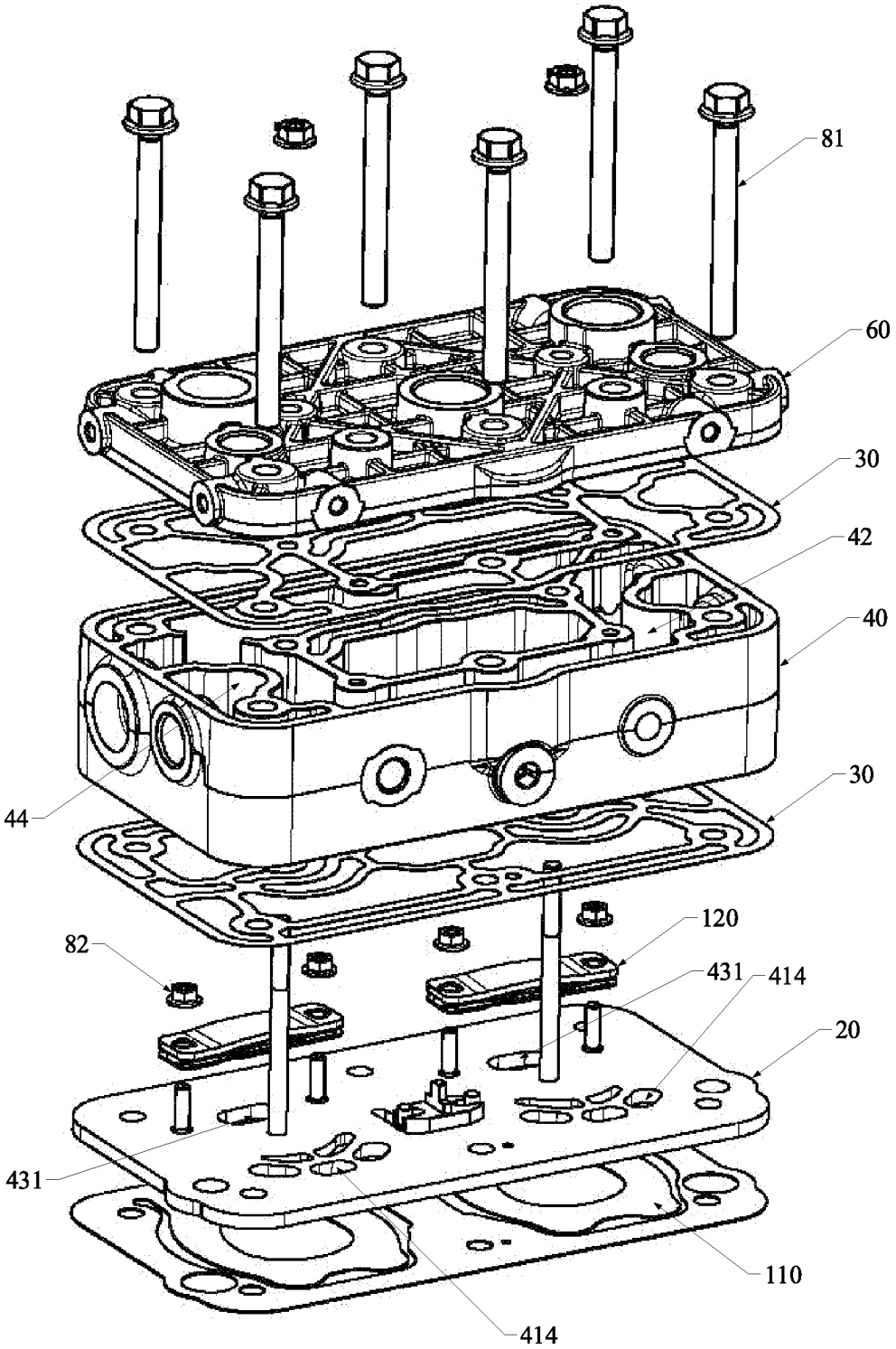
FIG. 1 is a schematic structural exploded diagram of an air compressor cylinder head according to an embodiment of the present invention.

Now exemplary implementations will be described more fully with reference to the accompanying drawings. However, the exemplary implementations can be implemented in many forms and should not be construed as being limited to the implementations set forth herein. On the contrary, these implementations are provided to make the present invention thorough and complete, and to fully convey the concept of the exemplary implementations to those skilled in the art.

The accompanying drawings are only schematic illustrations of the present invention, and are not necessarily drawn to scale. In the accompanying drawings, the same reference numerals denote the same or similar parts, and thus the repeated description thereof will be omitted. The terms "first", "second" and similar terms used in the specific description do not denote any order, quantity, or importance, but are merely used to distinguish different components.

Figure 2:
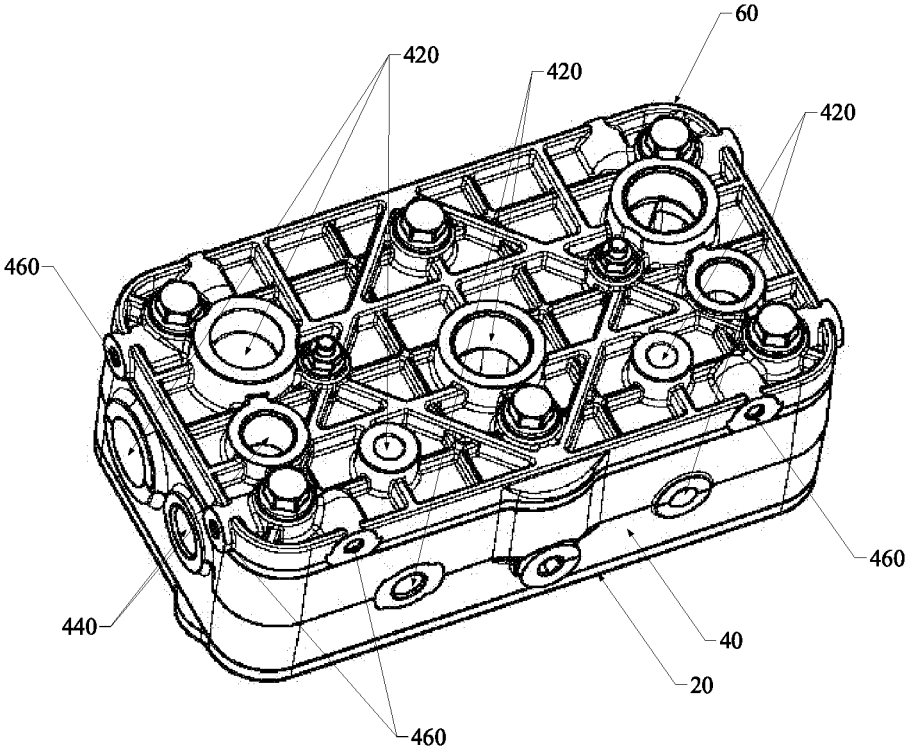
FIG. 2 and FIG. 3 are schematic structural diagrams of a first side of the air compressor cylinder head in an assembled state according to an embodiment of the present invention.
Figure 3:
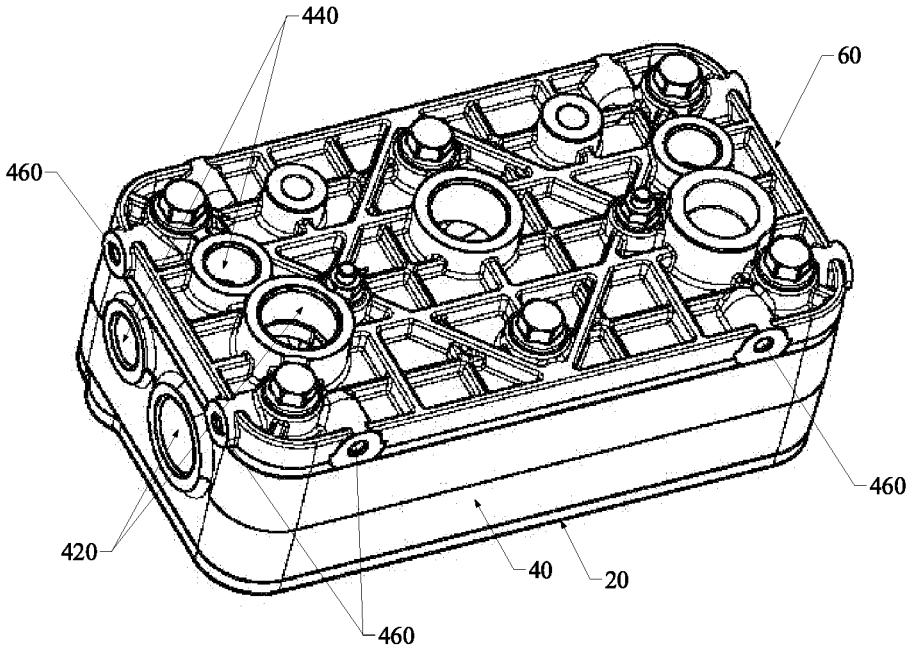
Figure 4:
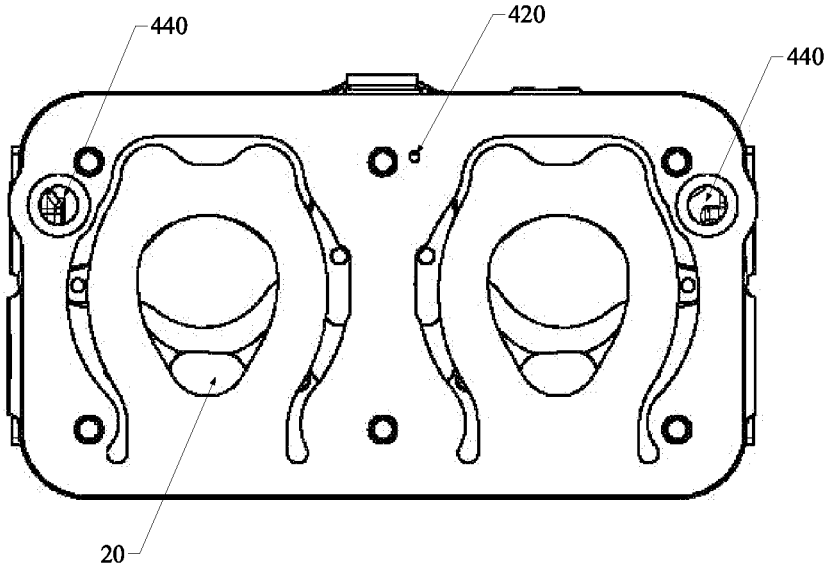
FIG. 4 is a schematic structural diagram of a second side of the air compressor cylinder head in an assembled state according to an embodiment of the present invention.

FIG. 1 shows an exploded structure of an air compressor cylinder head according to an embodiment, FIG. 2 and FIG. 3 show the structure of a first side of the air compressor cylinder head in an assembled state according to an embodiment, and FIG. 4 shows the structure of a second side of the air compressor cylinder head in an assembled state according to an embodiment. As shown in FIGS. 1-4, the air compressor cylinder head according to the embodiment of the present invention includes:

a valve seat plate 20, a manifold plate 40 and a cylinder cover 60 arranged in sequence;

wherein an inner cavity of the manifold plate 40 is provided with an air channel 42 and a liquid channel 44, the air channel 42 is provided with a plurality of air inlets and outlets 420, the liquid channel 44 is provided with a plurality of liquid inlets and outlets 440, and the air inlets and outlets 420 and the liquid inlets and outlets 440 are distributed on an end face of the cylinder cover 60, a side wall of the manifold plate 40 and an end face of the valve seat plate 20.

According to the air compressor cylinder head described above, the manifold plate 40 is arranged between the valve seat plate 20 and the cylinder cover 60 of the cylinder head, and the air channel 42 and the liquid channel 44 are arranged on the manifold plate 40, so that the structures of the valve seat plate 20 and the cylinder cover 60 can be simplified, and a plurality of complex parts can be replaced by one complex part, which simplifies processing of the cylinder head;

the air channel 42 and the liquid channel 44 are respectively provided with the plurality of air inlets and outlets 420 and the plurality of liquid inlets and outlets 440 that are distributed on the end face of the cylinder cover 60, the side wall of the manifold plate 40 and the end face of the valve seat plate 20, so that interfaces are flexibly arranged to adapt to the positions of interfaces of different air compressors; and in addition, the air channel 42 and the liquid channel 44 are arranged in the inner cavity of the manifold plate 40, so that the manifold plate 40 is relatively thick, which in turn makes the interfaces on the side wall of the manifold plate 40 be arranged more flexibly, and also facilitates adequate distribution of the air channel 42 and the liquid channel 44 in the inner cavity of the manifold plate 40, thereby improving the heat dissipation effect.

Figure 5:
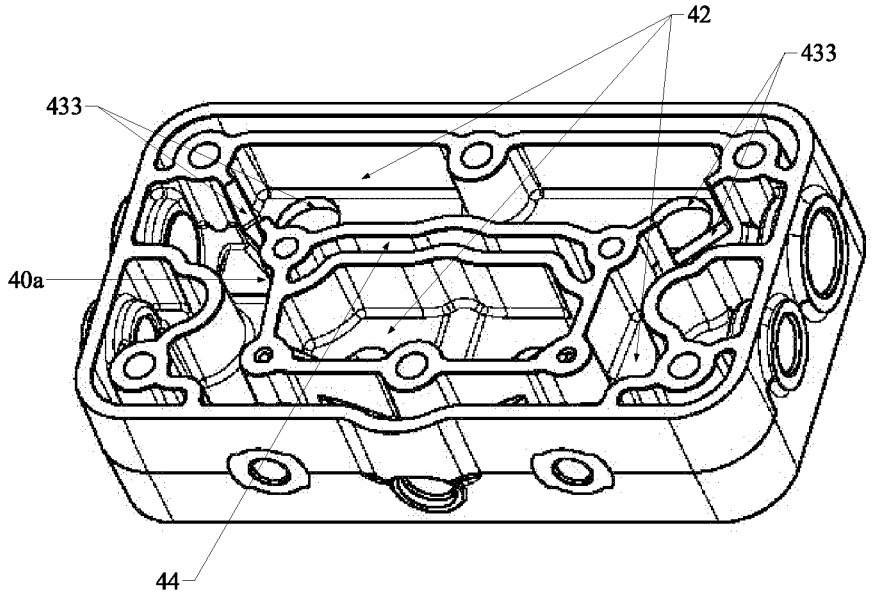
FIG. 5 and FIG. 6 are schematic structural diagrams of a first side and a second side of a manifold plate according to an embodiment of the present invention.
Figure 6:
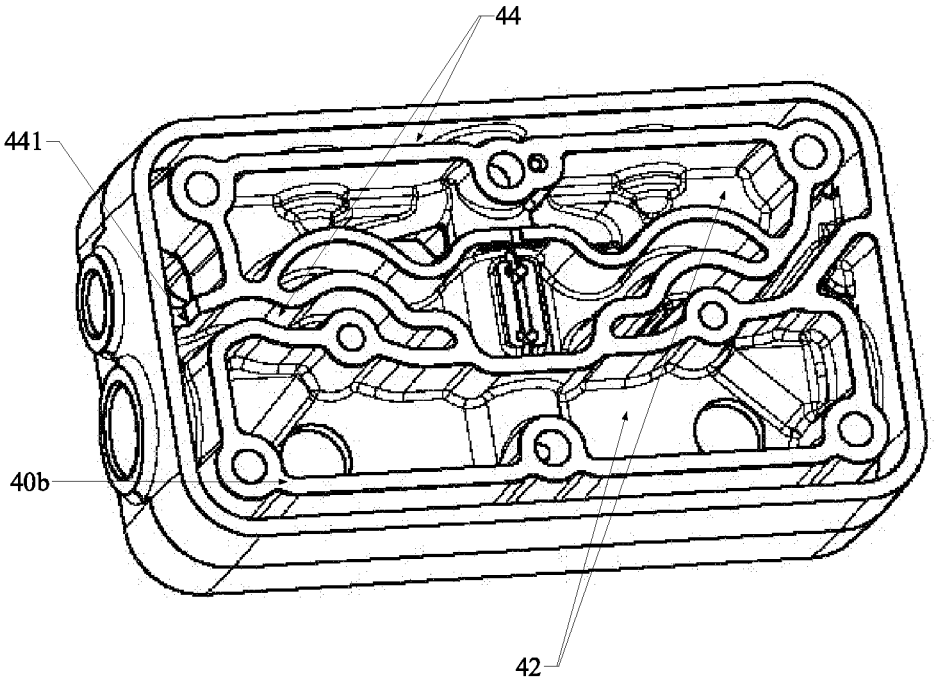

FIG. 5 and FIG. 6 show the structures of a first side and a second side of the manifold plate according to an embodiment. As shown in FIGS. 1, 5 and 6, in some embodiments, the inner cavity of the manifold plate 40 includes two layers respectively in communication with the cylinder cover 60 and the valve seat plate 20, and specifically includes a first layer 40*a* in communication with the cylinder cover 60 and a second layer 40*b* in communication with the valve seat plate 20; and the air channel 42 and the liquid channel 44 are spread all over the two layers of the manifold plate 40, and the air channel 42 and the liquid channel 44 are not in communication with each other.

With the first layer 40*a* and the second layer 40*b* of the manifold plate 40, in one aspect, communication with the cylinder cover 60 and the valve seat plate 20 is realized, in another aspect, the air channel 42 and the liquid channel 44 not in communication with each other can be conveniently formed in the inner cavity of the manifold plate 40, and the air channel 42 and the liquid channel 44 are spread all over the two layers of the manifold plate 40 to facilitate heat dissipation.

Figure 7:
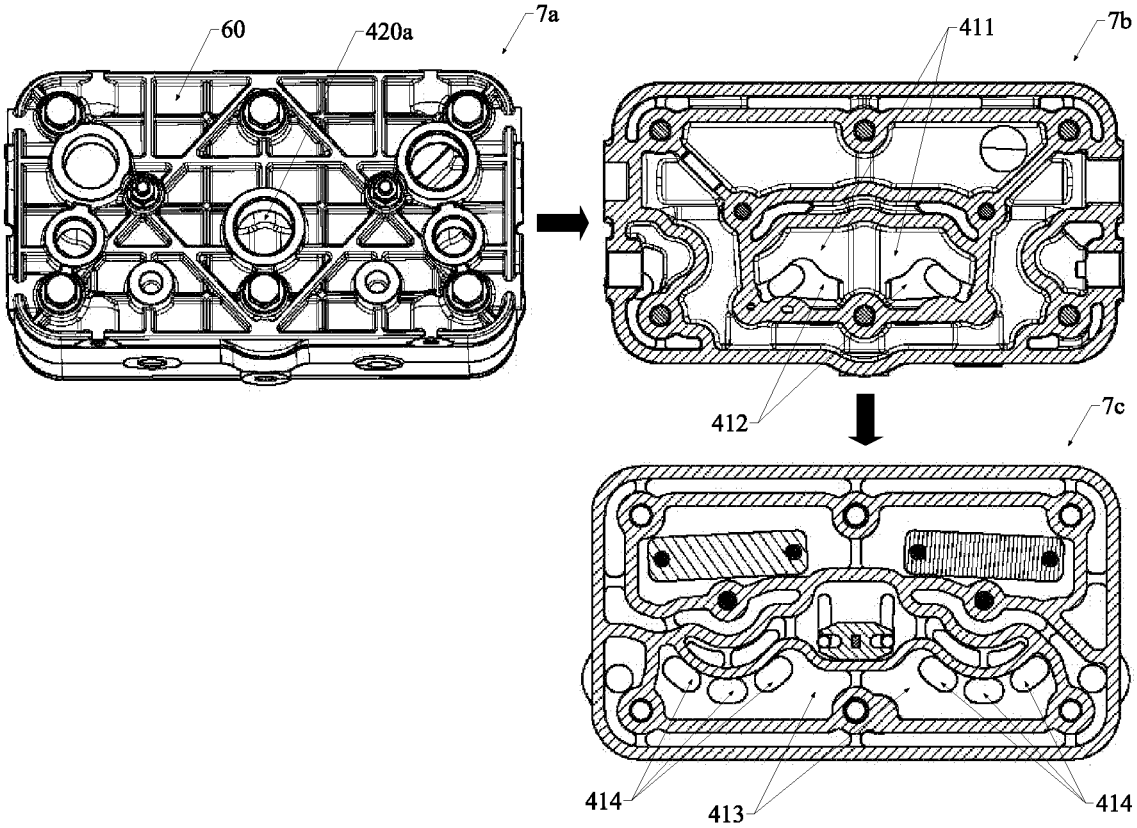
FIG. 7 is a schematic structural diagram of an intake channel of the air compressor cylinder head according to an embodiment of the present invention.

FIG. 7 shows the structure of an intake channel of the air compressor cylinder head according to an embodiment, and FIG. 7 specifically shows the intake channel in combination with the intake process (7*a*→7*b*→7*c*) of the air compressor. As shown in FIGS. 1-3 and 5-7, in some embodiments, the air inlet and outlet 420 includes: at least one air inlet 420*a* distributed on the end face of the cylinder cover 60; the air channel 42 includes: an intake channel leading from the air inlet 420*a* to an intake hole 414 of the valve seat plate 20 through a first-layer intake cavity 411 of the manifold plate 40, an intake path 412 between the two layers of the manifold plate 40 and a second-layer intake cavity 413 of the manifold plate 40.

Air entering the cylinder head through the air inlet 420*a* is atmospheric air or turbocharged air; and after being drawn into the cylinder head through the air inlet 420*a*, air is conveyed into a cylinder through the intake channel of the cylinder head for compression.

Figure 8:
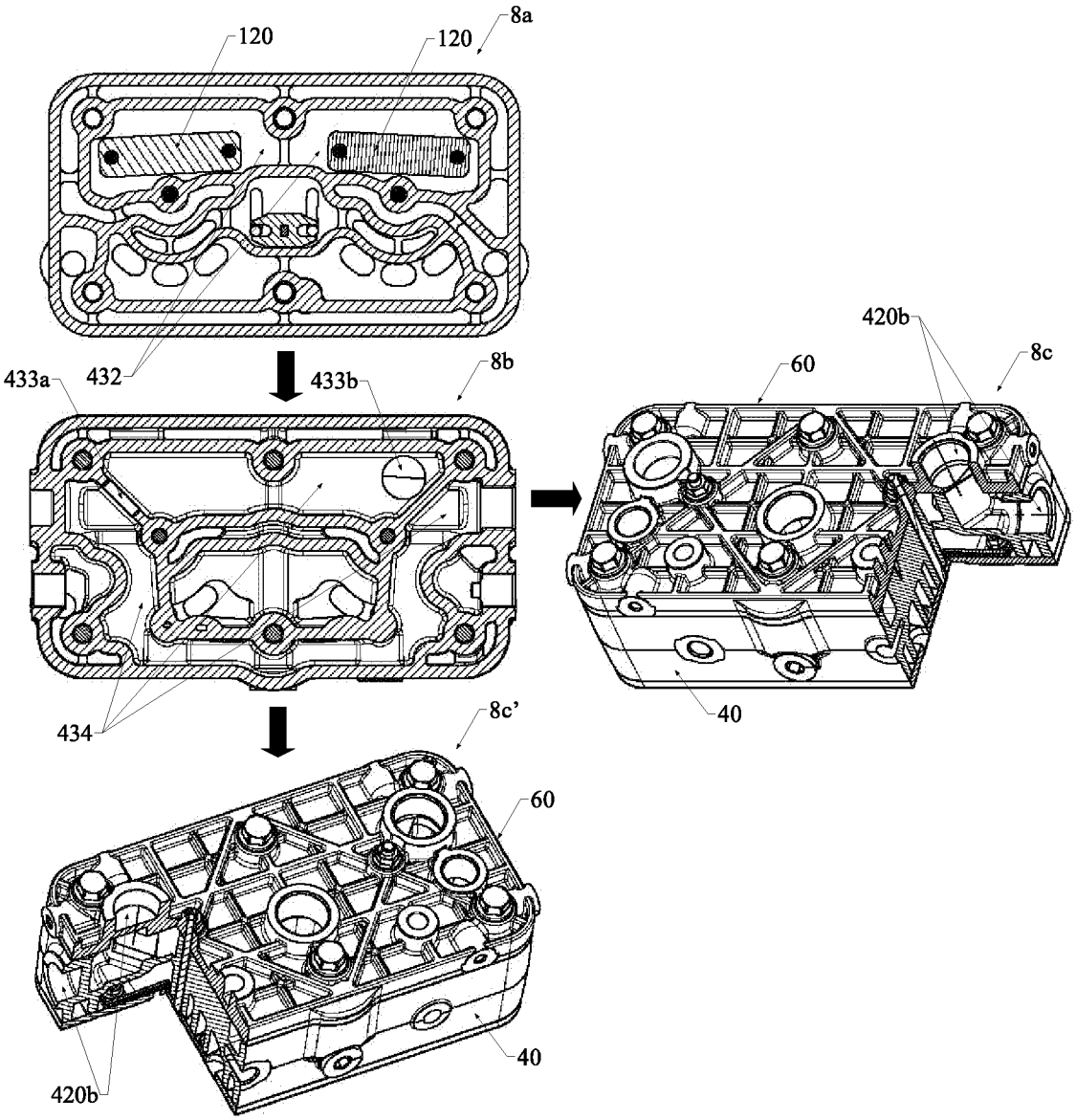
FIG. 8 is a schematic structural diagram of an exhaust channel of the air compressor cylinder head according to an embodiment of the present invention.

FIG. 8 shows the structure of an exhaust channel of the air compressor cylinder head according to an embodiment, and FIG. 8 specifically shows the exhaust channel in combination with the exhaust process (8*a*→8*b*→8*c*/8*c*') of the air compressor. As shown in FIGS. 1-3, 5, 6 and 8, in some embodiments, the air inlet and outlet 420 further includes: a plurality of air outlets 420*b* distributed on the side wall of the manifold plate 40 and the end face of the cylinder cover 60; and an exhaust channel leading from an exhaust hole 431 of the valve seat plate 20 to the air outlet 420*b* through a second-layer exhaust cavity 432 of the manifold plate 40, exhaust paths 433*b*, 433*a* between the two layers of the manifold plate 40 and a first-layer exhaust cavity 434 of the manifold plate 40.

Air entering the cylinder is compressed into high-pressure air, which is discharged through the exhaust hole 431, flows to the air outlet 420*b* through the exhaust channel in the cylinder head, and finally enters an air storage tank for storage and later use after passing through an air handling unit and a series of pipelines of a vehicle.

The intake cavity and the exhaust cavity of the manifold plate 40 are not in communication with each other, ensuring that the intake process and the exhaust process of the air compressor do not affect each other.

Moreover, in the cylinder head, the air inlet 420*a* and the air outlet 420*b* are both preliminarily processed into blind holes; and when the cylinder head is applied to a specific air compressor, one appropriate air inlet 420*a* and one appropriate air outlet 420*b* may be processed and molded according to the positions of the interfaces of the air compressor. With the solution of blank casting (i.e., preliminarily processing the air inlet 420*a* and the air outlet 420*b* into the blind holes), in specific use of the cylinder head, only the air inlet 420*a* and the air outlet 420*b* in corresponding positions need to be machined according to the positions of the interfaces of the air compressor, and those not selected do not need to be machined, which not only realizes extremely flexible and diverse interface adaptability, but also reduces the mold cost and accelerates the research and development of new products.

In this embodiment, the air inlet 420*a* at one position and the air outlets 420*b* at four different positions are designed in total, which is not limited thereto; in different embodiments, the number and distribution of the air inlets 420*a*/air outlets 420*b* may be adjusted; and in practical application, any one air inlet 420*a* and any one air outlet 420*b* may be selected for machining according to overall arrangement requirements of the air compressor.

Further, in some embodiments, as shown in FIGS. 1, 7 and 8, an intake end face of the valve seat plate 20 is provided with an intake valve 110 covering the intake hole 414, and an exhaust end face of the valve seat plate 20 is provided with an exhaust valve 120 covering the exhaust hole 431. During the intake process, the intake valve 110 is opened, so that air smoothly enters the cylinder from the intake hole 414; during the compression process, the intake valve 110 is closed to ensure airtightness of the cylinder; and during the exhaust process, the exhaust valve 120 is opened to make air be discharged from the exhaust hole 431.

Figure 9:
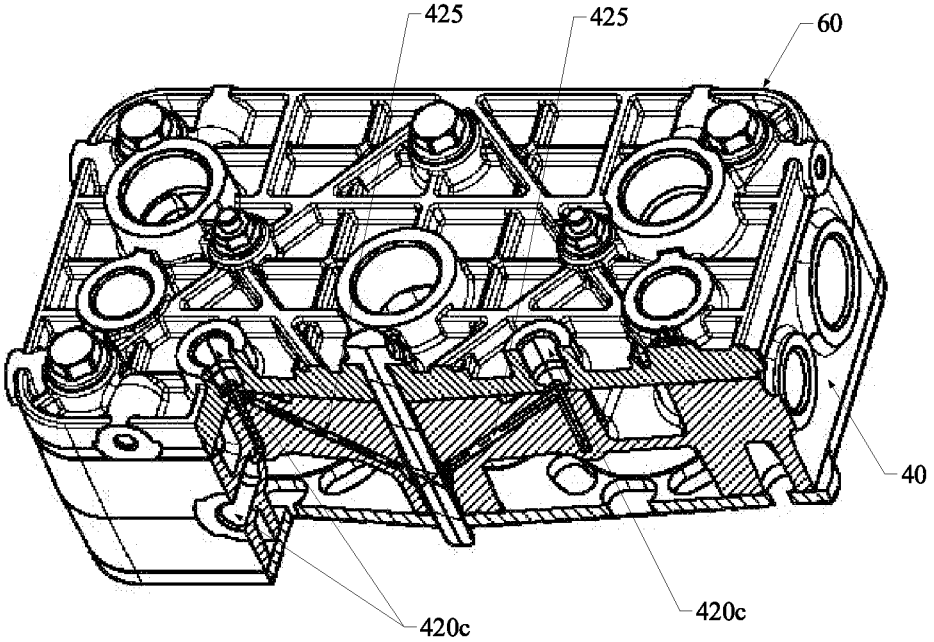
FIG. 9 and FIG. 10 are schematic structural diagrams of an unloading channel of the air compressor cylinder head according to an embodiment of the present invention.
Figure 10:
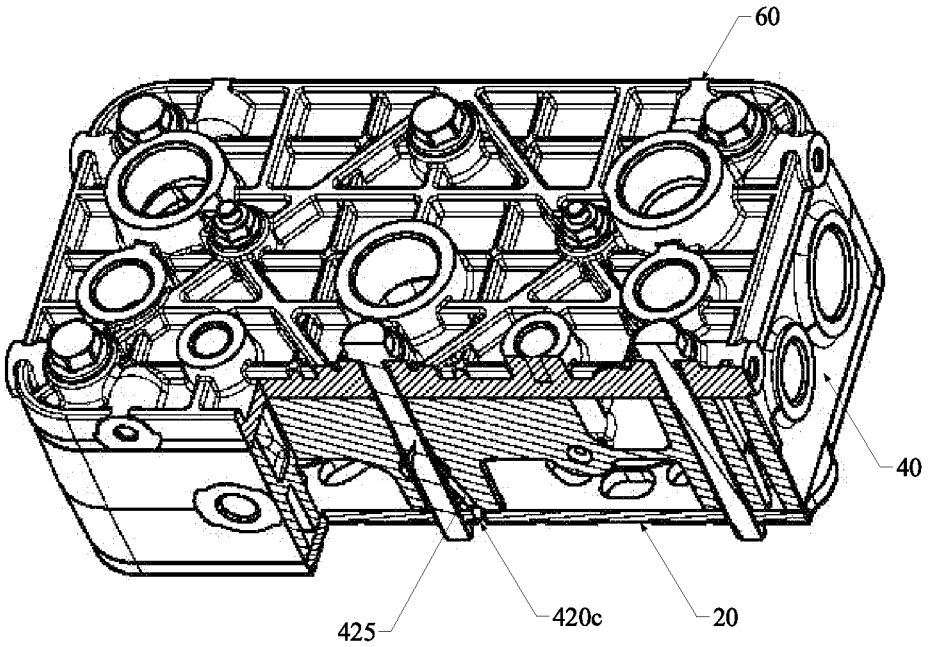

FIG. 9 and FIG. 10 show the structure of an unloading channel of the air compressor cylinder head according to an embodiment. As shown in FIGS. 2, 4, 9 and 10, in some embodiments, the air inlet and outlet 420 further includes: a plurality of unloading control ports 420*c* distributed on the end face of the cylinder cover 60, the side wall of the manifold plate 40 and the end face of the valve seat plate 20; the air channel 42 further includes: an unloading channel 425 leading from the unloading control port 420*c* to a piston chamber of the manifold plate 40.

The air compressor may stop working to reduce energy consumption after the pressure of the air storage tank reaches a specified value, which is called as an unloading state. A control signal air source for controlling the air compressor to be unloaded enters the piston chamber of the manifold plate 40 through the unloading control port 420*c* and the unloading channel 425 to push a piston to move so as to realize unloading.

The unloading control port 420*c* is also preliminarily processed into a blind hole; and when the cylinder head is applied to a specific air compressor, one appropriate unloading control port 420*c* and the corresponding unloading channel 425 may be processed and molded according to the positions of the interfaces of the air compressor. With the solution of blank casting, in specific use of the cylinder head, only the unloading control port 420*c* and the unloading channel 425 in corresponding positions need to be machined according to the positions of the interfaces of the air compressor, and those not selected do not need to be machined, which not only realizes extremely flexible and diverse interface adaptability, but also reduces the mold cost and accelerates the research and development of new products.

In this embodiment, five unloading control ports 420*c* at different positions are designed in total, four of which are in the cylinder head and the other is in a crankcase, which is not limited thereto; in different embodiments, the number and distribution of the unloading control ports 420*c* may be adjusted; and in practical application, any one unloading control port 420*c* may be selected for machining according to overall arrangement requirements of the air compressor.

Moreover, the piston chamber of the manifold plate 40 is not in communication with the intake cavity or the exhaust cavity of the manifold plate 40, ensuring that the unloading process and the intake and exhaust processes of the air compressor do not affect each other.

Figure 11:
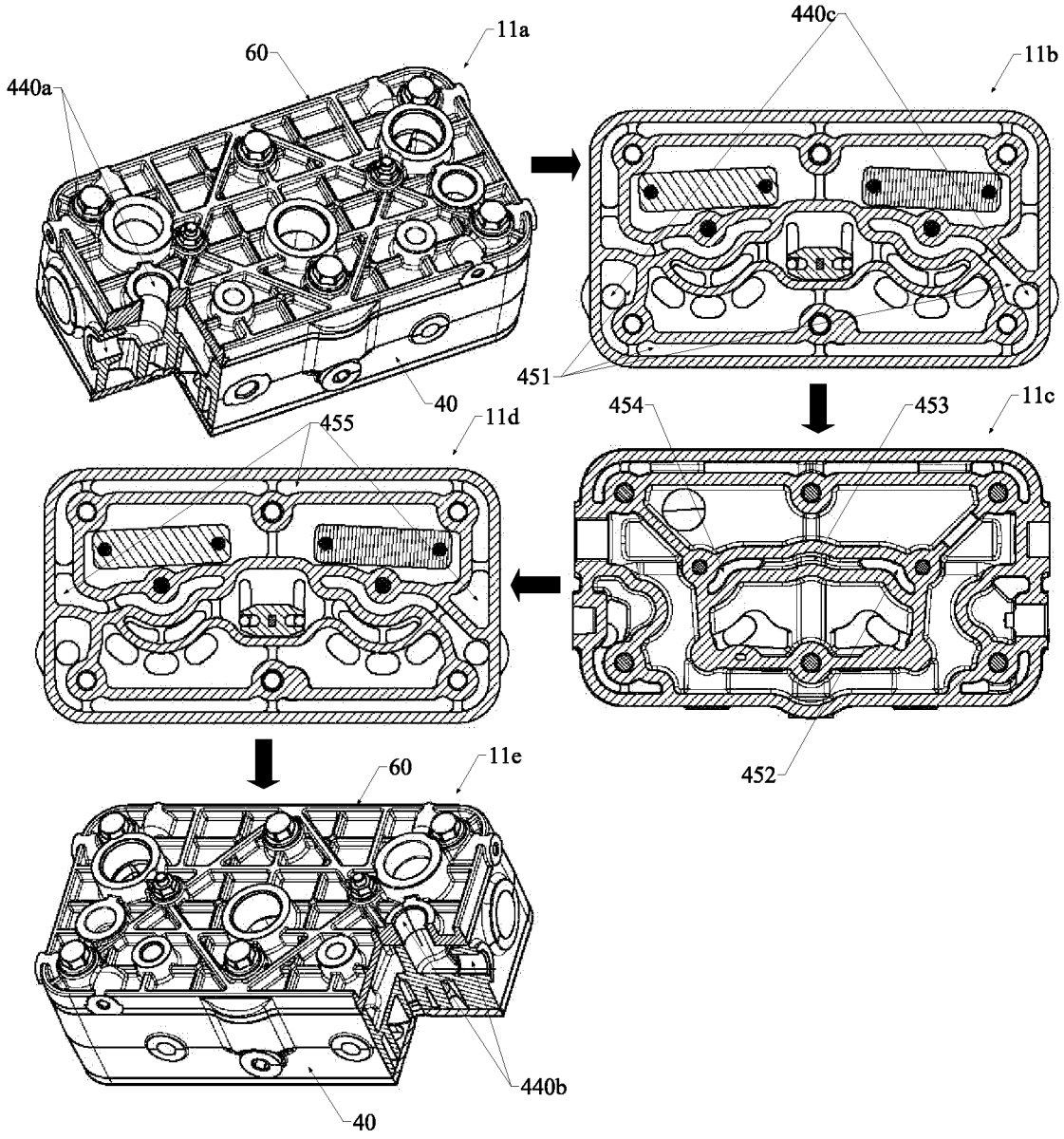
FIG. 11 is a schematic structural diagram of a liquid channel of the air compressor cylinder head according to an embodiment of the present invention.

FIG. 11 shows the structure of the liquid channel of the air compressor cylinder head according to an embodiment, and FIG. 11 specifically shows the liquid channel in combination with the cooling process (11*a*→11*b*→11*c*→11*d*→11*e*) of the air compressor. As shown in FIGS. 2-6 and 11, in some embodiments, the liquid inlet and outlet 440 includes: a plurality of liquid inlets 440*a* distributed on the end face of the cylinder cover 60 and the side wall of the manifold plate 40; and a plurality of liquid outlets 440*b* distributed on the end face of the cylinder cover 60 and the side wall of the manifold plate 40, wherein the liquid outlets 440*b* and the liquid inlets 440*a* are distributed at two ends of one or more continuously through liquid channels and are in communication with an external liquid path of the cylinder head; and the liquid outlets 440*b* and the liquid inlets 440*a* may be used interchangeably.

The liquid channel 44 leads from the liquid inlet 440*a* to the liquid outlet 440*a* through a first liquid path 451 of a second layer of the manifold plate 40, a first liquid path 452 between the two layers of the manifold plate 40, a liquid path 453 of the first layer of the manifold plate 40, a second liquid path 454 between the two layers of the manifold plate 40 and a second liquid path 455 of the second layer of the manifold plate 40.

An engine coolant may be introduced into the liquid channel 44 for cooling; and the coolant may fully flow through the first layer 40*a* and the second layer 40*b* of the manifold plate 40 via the liquid channel 44, so as to increase the area of contact with the cylinder head and enhance the cooling and heat dissipation effect of the cylinder head.

In some embodiments, the liquid inlet 440*a* and the liquid outlet 440*b* are both preliminarily processed into blind holes; and when the cylinder head is applied to a specific air compressor, a pair of appropriate liquid inlet 440*a* and liquid outlet 440*b* may be processed and molded according to the positions of the interfaces of the air compressor. With the solution of blank casting, in specific use of the cylinder head, only the liquid inlet 440*a* and the liquid outlet 440*b* in corresponding positions need to be machined according to the positions of the interfaces of the air compressor, and those not selected do not need to be machined, which not only realizes extremely flexible and diverse interface adaptability, but also reduces the mold cost and accelerates the research and development of new products.

Further, as shown in FIGS. 4 and 11, in some embodiments, the liquid inlet and outlet 440 further includes: a pair of crankcase liquid ports 440*c* which are arranged on the end face of the valve seat plate 20, are respectively in communication with two ends of the first liquid path 451 of the second layer of the manifold plate 40 and are in communication with a water channel of a crankcase of the air compressor.

Therefore, a part of the coolant entering the first liquid path 451 of the second layer of the manifold plate 40 from the liquid inlet 440*a* may flow into the water channel of the crankcase from one crankcase liquid port 440*c*, and then flow back to the first liquid path 451 of the second layer of the manifold plate 40 from the other crankcase liquid port 440*c* after cooling the crankcase; and the other part of the coolant flows along the first liquid path 451 of the second layer of the manifold plate 40, and after joining the coolant returned from the crankcase, continues to flow into the first liquid path 452 between the two layers of the manifold plate 40.

The crankcase liquid port 440*c* is also preliminarily processed into a blind hole; and when the cylinder head is applied to a specific air compressor, whether to machine the crankcase liquid port 440*c* can be determined as required.

In this embodiment, two liquid inlets 440*a* at different positions and two liquid outlets 440*b* at different positions are designed for the cylinder head, and a pair of crankcase liquid ports 440*c* are also provided for the crankcase, which is not limited thereto; in different embodiments, the number and distribution of the liquid inlets 440*a*/the liquid outlets 440*b*/the crankcase liquid ports 440*c* may be adjusted; and in practical application, any one pair of liquid inlets 440*a* and liquid outlets 440*b*/any one pair of crankcase liquid ports 440*c* may be selected for machining according to overall arrangement requirements of the air compressor.

Further, referring to FIG. 2 and FIG. 3, the cylinder head is further provided with a plurality of pipeline fixing holes 460 distributed on the side wall of the cylinder cover 60. The pipeline fixing hole 460 may be configured to fix a pipeline, is processed into a pre-cast hole, and may be machined as required in practical application.

In this embodiment, eight pipeline fixing holes 460 at different positions are designed for the cylinder head, which is not limited thereto; in different embodiments, the number and distribution of the pipeline fixing holes 460 may be adjusted; and in practical application, the appropriate pipeline fixing hole 460 may be selected for machining according to overall arrangement requirements of the air compressor.

The flexible interfaces, such as the air inlet and outlet 420 and the liquid inlet and outlet 440, may adapt to the positions of interfaces of different air compressors and thus achieve strong adaptability; and the interfaces on the cylinder head adopt the solution of universal blank casting, in practical application, it only requires to machine the interface at the corresponding position of the cylinder head according to the position of the interface of the air compressor, which not only realizes extremely flexible and diverse interface adaptability, but also reduces the mold cost and accelerates the research and development of new products.

Further, referring to FIG. 1, in some embodiments, the cylinder head further includes: two sealing gaskets 30 respectively arranged between the cylinder cover 60 and the manifold plate 40, and between the manifold plate 40 and the valve seat plate 20. The sealing gasket 30 enables a sealing connection between the cylinder cover 60 and the manifold plate 40, and between the manifold plate 40 and the valve seat plate 20.

All parts of the cylinder head may be in tight connection by means of a bolt 81 and a nut 82.

An embodiment of the present invention further provides an air compressor, and a crankcase of the air compressor is covered with an air compressor cylinder head as described in any of the above embodiments. Both the features and principles of the air compressor cylinder head described in any of the above embodiments may be applied to the air compressor in this embodiment; and the features and principles of the air compressor cylinder head that have been illustrated will not be repeated herein.

In summary, the air compressor cylinder head and the air compressor according to the present invention have the following beneficial effects:

the manifold plate 40 is arranged between the valve seat plate 20 and the cylinder cover 60 of the cylinder head, and the air channel 42 and the liquid channel 44 are arranged on the manifold plate 40, so that the structures of the valve seat plate 20 and the cylinder cover 60 can be simplified, and a plurality of complex parts can be replaced by one complex part, which simplifies processing of the cylinder head;

the air channel 42 and the liquid channel 44 are respectively provided with the plurality of air inlets and outlets 420 and the plurality of liquid inlets and outlets 440 that are distributed on the end face of the cylinder cover 60, the side wall of the manifold plate 40 and the end face of the valve seat plate 20, so that the interfaces are flexibly arranged to adapt to the positions of interfaces of different air compressors; and in addition, the air channel 42 and the liquid channel 44 are arranged in the inner cavity of the manifold plate 40, so that the manifold plate 40 is relatively thick, which in turn makes the interfaces on the side wall of the manifold plate 40 be arranged more flexibly, and also facilitates adequate distribution of the air channel 42 and the liquid channel 44 in the inner cavity of the manifold plate 40, thereby improving the heat dissipation effect.

It should be noted that the embodiments in the present invention and features of the various embodiments can be combined with each other without conflict. In order to realize these combinations, some features of some parts are cast or pre-processed into blind holes or impassable states, and are broken through by means of machining only when necessary to realize external connection and internal fluid guidance. These features include but are not limited to:

1) the manifold plate 40: the crankcase liquid port 440*c*; an internal air gap 433 for air guidance (including the exhaust paths 433*b*, 433*a* between the two layers of the manifold plate 40); an internal liquid gap 441 for liquid guidance; an external air interface, namely, the air inlet and outlet 420; an external liquid interface, namely, the liquid inlet and outlet 440.

2) the cylinder cover 60: the external air interface, namely, the air inlet and outlet 420; the external liquid interface, namely, the liquid inlet and outlet 440; the pipeline fixing hole 460.

The above is a further detailed description of the present invention with reference to the specific preferred implementations, and it cannot be considered that the specific implementation of the present invention is limited to these descriptions. For those of ordinary skill in the art of the present invention, several simple deductions or substitutions can be further made without departing from the concept of the present invention, and should be regarded as falling within the scope of protection of the present invention.

What is claimed is:

1. An air compressor cylinder head, comprising a valve seat plate, a manifold plate and a cylinder cover arranged in sequence;

wherein an inner cavity of the manifold plate is provided with an air channel and a liquid channel, wherein the air channel is provided with a plurality of air inlets and outlets, the liquid channel is provided with a plurality of liquid inlets and outlets, and wherein the air inlets and outlets and the liquid inlets and outlets are distributed on an end face of the cylinder cover, a side wall of the manifold plate and an end face of the valve seat plate;

wherein the inner cavity of the manifold plate comprises two layers respectively in communication with the cylinder cover and the valve seat plate;

wherein the plurality of air inlets and outlets comprises:

at least one air inlet distributed on the end face of the cylinder cover; and a plurality of air outlets distributed on the side wall of the manifold plate and the end face of the cylinder cover;

and wherein the air channel comprises:

an intake channel leading from the air inlet to an intake hole of the valve seat plate through a first-layer intake cavity of the manifold plate, an intake path between the two layers of the manifold plate and a second-layer intake cavity of the manifold plate; and an exhaust channel leading from an exhaust hole of the valve seat plate to the air outlet through a second-layer exhaust cavity of the manifold plate, an exhaust path between the two layers of the manifold plate and a first-layer exhaust cavity of the manifold plate;

wherein the intake cavity and the exhaust cavity of the manifold plate are not in communication with each other.

2. The cylinder head according to claim 1, wherein the air channel and the liquid channel are spread all over the two layers of the manifold plate, and the air channel and the liquid channel are not in communication with each other.

3. The cylinder head according to claim 1, further comprising:

an intake valve arranged on an intake end face of the valve seat plate and covering the intake hole; and an exhaust valve arranged on an exhaust end face of the valve seat plate and covering the exhaust hole.

4. The cylinder head according to claim 2, wherein the plurality of air inlets and outlets further comprises:

a plurality of unloading control ports distributed on the end face of the cylinder cover, the side wall of the manifold plate and the end face of the valve seat plate; and wherein the air channel further comprises:

an unloading channel leading from the plurality of unloading control ports to a piston chamber of the manifold plate; and wherein the piston chamber is not in communication with the intake cavity or the exhaust cavity of the manifold plate.

5. The cylinder head according to claim 2, wherein the plurality of liquid inlets and outlets comprises:

a plurality of liquid inlets distributed on the end face of the cylinder cover and the side wall of the manifold plate; and a plurality of liquid outlets distributed on the end face of the cylinder cover and the side wall of the manifold plate, wherein the liquid outlets and the liquid inlets are distributed at two ends of one or more continuously through liquid channels and are in communication with an external liquid path of the cylinder head;

wherein the liquid channel leads from the liquid inlet to the liquid outlet through a first liquid path of a second layer of the manifold plate, a first liquid path between the two layers of the manifold plate, a liquid path of the first layer of the manifold plate, a second liquid path between the two layers of the manifold plate and a second liquid path of the second layer of the manifold plate.

6. The cylinder head according to claim 5, wherein the liquid inlet and outlet further comprises:

a pair of crankcase liquid ports which are arranged on the end face of the valve seat plate, are respectively in communication with two ends of the first liquid path of the second layer of the manifold plate and are in communication with a water channel of a crankcase of an air compressor.

7. The cylinder head according to claim 1, further comprising:

a plurality of pipeline fixing holes distributed on the side wall of the cylinder cover.

8. The cylinder head according to claim 7, wherein the plurality of pipeline fixing holes are processed into a precast hole.

9. The cylinder head according to claim 1, wherein the plurality of air inlets and outlets and the plurality of liquid inlets and outlets are preliminarily processed into blind holes.

10. The cylinder head according to claim 1, further comprising:

two sealing gaskets respectively arranged between the cylinder cover and the manifold plate, and between the manifold plate and the valve seat plate.

11. An air compressor, wherein a crankcase of the air compressor is covered with an air compressor cylinder head according to claim 1.

* * * * *